US006550659B1

(12) United States Patent
Kortman et al.

(10) Patent No.: US 6,550,659 B1
(45) Date of Patent: Apr. 22, 2003

(54) APPARATUS FOR MANUFACTURING INDUSTRIAL COMPONENT HOLDER ASSEMBLIES

(75) Inventors: Calvin J. Kortman, Holland, MI (US); Mark A. Kortman, Holland, MI (US); Joyce E. Kortman, Holland, MI (US)

(73) Assignee: Production Assembly Service, Inc., Holland, MI (US)

( * ) Notice: Subject to any disclaimer, the term of this patent is extended or adjusted under 35 U.S.C. 154(b) by 76 days.

(21) Appl. No.: 09/838,836

(22) Filed: Apr. 20, 2001

(51) Int. Cl.[7] ..... B27F 7/02

(52) U.S. Cl. ..... 227/44; 227/100; 227/110; 227/153

(58) Field of Search ..... 227/99, 100, 110, 227/107, 101, 104, 44, 48, 39, 153, 154, 152, 7

(56) References Cited

U.S. PATENT DOCUMENTS 3,876,128 A * 4/1975 Feren ..... 227/152
4,054,236 A * 10/1977 Paxton ..... 227/100
4,203,541 A * 5/1980 Gravitter et al. ..... 227/153
4,254,895 A * 3/1981 Cheak ..... 227/100
4,708,276 A * 11/1987 Knoth et al. ..... 227/7
4,793,540 A * 12/1988 Mangan et al. ..... 227/100
5,058,795 A * 10/1991 Tonus ..... 227/110

* cited by examiner

*Primary Examiner*—Scott A. Smith
(74) *Attorney, Agent, or Firm*—Van Dyke, Gardner, Linn & Burkhart, LLP

(57) ABSTRACT

An apparatus for manufacturing a component holder assembly includes a frame, a plurality of stapler assemblies, which are supported by the frame, and a support surface. The stapler assemblies are aligned along a common axis for ejecting staples along the common axis. The support surface is provided to support at least a first side frame member of a component holder assembly whereby a portion of the first side frame member can be aligned with the stapler assemblies. The apparatus further includes an actuator for actuating at least a group of the stapler assemblies to eject staples generally along the common axis to form a seam for connecting a shelf member of a component holder assembly to a first side frame member of the component holder assembly.

39 Claims, 9 Drawing Sheets

APPARATUS FOR MANUFACTURING INDUSTRIAL COMPONENT HOLDER ASSEMBLIES

TECHNICAL FIELD AND BACKGROUND OF THE INVENTION

The present invention relates to an apparatus for manufacturing industrial component holder assemblies.

Recently, self-supporting collapsible component holder assemblies have been designed which permit easy placement of a holder assembly in existing rack frames, which are typically rigid open frames that are stackable. Since the component holder assemblies are self-supporting, they need not be secured to the frame and, further, as a result allow quick interchange of the component holder assembly so that a single rack frame can be used to support a variety of different components by simply replacing one holder assembly for another. As disclosed in co-pending U.S. patent application entitled INDUSTRIAL COMPONENT HOLDER ASSEMBLY AND RACK, Ser. No. 09/536,662, filed Mar. 27, 2000, now U.S. Pat. No. 6,305,764, (which is herein incorporated by reference in its entirety), the components that form these collapsible, self-supporting holder assemblies are currently assembled by stitching, which are performed by operators, but may also be assembled using fasteners, including staples. However, as will be understood from the description below, stapling of theses assemblies using conventional staplers is difficult due to the width of the shelves. The holder assemblies include a plurality of side members and shelf elements, which are interconnected to form a plurality of vertically spaced and, in some cases, horizontally spaced shelves. The depth of the shelves varies on the products or components being supported, but may for example extend three or four feet or more. Each shelf element is connected, such as by stitching, on its opposed ends to the side members to thereby form the collapsible holder assembly. However, these assembly methods are slow and expensive as they require considerable labor.

More recently, collapsible component holder assemblies have been designed which include substantially rigid shelf elements that extend between flexible side members so that the holder assembly, though not self-supporting, is collapsible, such as disclosed in co-pending U.S. Pat. application, Ser. No. 09/838,985, filed Apr. 20, 2001, which is incorporated by reference by reference herein in its entirety. These assemblies are also assembled by stitching, but in preferred form are assembled using staples or other fasteners. However, as noted above, given the width of the holder assemblies stapling is difficult.

Consequently, there is a need for a more simplified method of assembling components of holder assemblies that are heretofore typically stitched, and a method that would enable the use of staples for fastening the components of the holder assemblies together, regardless of the width of the holder assembly.

SUMMARY OF THE INVENTION

The present invention provides an apparatus that automates the manufacturing of the collapsible component holder assemblies.

According to one form of the invention, an apparatus for manufacturing a component holder assembly includes a frame, a plurality of stapler assemblies, and a support surface for supporting at least a first side frame member of a component holder assembly. A plurality of stapler assemblies are supported by the frame and are generally aligned along a common axis for ejecting staples along the common axis. A support surface supports the first side frame member in a manner such that a portion of the first side frame member can be aligned with the stapler assemblies. In addition, the apparatus further includes means for actuating at least a group of the stapler assemblies to eject staples generally along the common axis to form a seam for connecting a shelf member of the component assembly to the first side frame member of the component holder assembly.

In another aspect, the plurality of stapler assemblies are pivotally mounted to the frame whereby rotation of the stapler assemblies adjusts the orientation of the common axis for adjusting the orientation of the seam.

In yet another aspect, the apparatus further includes an indexing assembly which includes at least one gripper for holding the first side frame member of a component assembly and for moving the first side frame member across the support surface for indexing the first side frame member and aligning other portions of the first side frame member with the stapler assembly. For example, the indexing assembly may be mounted to the frame.

In a further aspect, the indexing assembly includes a gripper assembly which includes grippers. The grippers are for gripping the first side frame member and moving the first side frame member across the support surface for repositioning the first side frame member with respect to the stapler assemblies. In yet a further aspect, the gripper assembly includes a gripper assembly frame and carriage, with the grippers supported by the carriage. The carriage is movably mounted to the gripper assembly frame. For example, the carriage may include a plurality of rails with the gripper assembly frame including a plurality of bearing assemblies, with the rails being movably supported by the bearing assemblies whereby the carriage moves relative to the gripper assembly frame for indexing the first side frame member.

In other aspects, the apparatus includes a second support surface which is positioned below the first support surface whereby the first side frame member is positionable on the second surface after the first side frame member is stapled to the shelf member and optional subsequent shelf members. In preferred form, the second support surface is repositionable with respect to the first support surface to accommodate a plurality of side frame members. In addition, the second support surface may comprise a conveyor surface, such as a roller conveyor surface.

According to another form of the invention, an apparatus for manufacturing component holder assembly includes a frame, a support arm supported by the frame, and a plurality of stapler assemblies supported by the support arm. The stapler assemblies are generally aligned along a common axis for ejecting staples along the common axis. The apparatus further includes a support surface for supporting at least a first side frame member of a component holder assembly such that a portion of the first side frame member is alignable with the stapler assembly. In addition, the apparatus includes a control system for actuating the stapler assemblies to eject staples aligned generally along the common axis to form a seam for connecting a shelf member to the first side frame member of the component holder assembly.

In one aspect, the apparatus includes a means for indexing the first side frame member whereby different portions of the side frame member are alignable with the stapler assemblies for connecting additional shelf members to the first side frame member.

In a further aspect, the apparatus includes two support surfaces, with the second support surface positioned below the first support surface. In this manner, the first side frame member is positionable on the second surface after the first side frame member is stapled to the shelf member and the optional additional subsequent shelf members. In yet another aspect, the apparatus further includes a lift assembly which raises and lowers the second support surface. For example, the control system may be in communication with the lift assembly whereby the control system selectively actuates the lift assembly.

In another aspect, the apparatus includes a striker member which is generally aligned below the stapler assemblies and aligned with the support surface whereby a portion of the first side frame member is positionable over the striker member when the means for indexing moves the first side frame member to align the portion of the first side frame member with the stapler assemblies. The striker member is configured to hold at least one member of the component holder assembly and may, for example, include an actuatable chuck, with the control system in communication with a chuck whereby the chuck is actuated for selectively holding at least one member of the component holder assembly.

According to yet another aspect of the invention, an apparatus for manufacturing component holder assemblies includes a frame, means for dispensing connectors generally aligned along a common axis for connecting one component of the holder assembly to another component of the holder assembly and for forming a seam with the connectors along the common axis. The apparatus further includes a support surface configured for supporting at least one component whereby a portion of the component is alignable with the means for dispensing. In addition, the apparatus includes a means for indexing the component whereby selected portions of the component is aligned with the means for dispensing.

These and other objects, advantages, purposes, and features of the invention will become more apparent from the study of the following description taken in conjunction with the drawings.

DETAILED DESCRIPTION OF THE PREFERRED EMBODIMENTS

Figure 1:
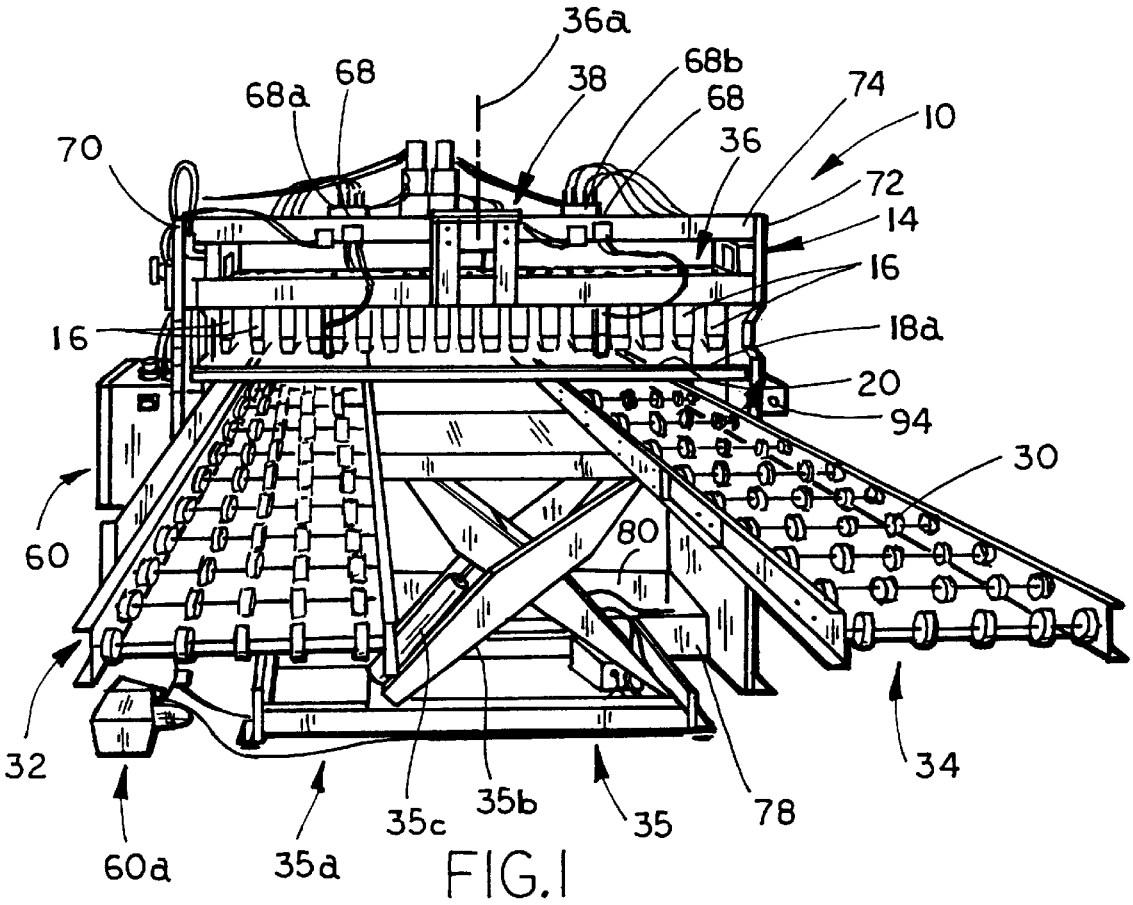
FIG. 1 is a front perspective view of the apparatus of the present invention.

Referring to FIG. 1, the numeral 10 generally designates a connector dispensing apparatus of the present invention for manufacturing industrial component assemblies which are assembled using connectors, such as staples. While reference is made herein to component holder assemblies, it will be understood by those skilled in the art that the apparatus of the present invention may be used to assemble other assemblies as well. Apparatus 10 is particularly suitable for connecting one or more components together in which a long seam is needed to be formed by the connectors, such as staples, that are dispensed by apparatus 10. Apparatus 10 automates a previously manual manufacturing process and decreases the assembly time, thus, reducing the cost of manufacturing the components, such as a component holder assembly 12 illustrated in FIGS. 3 and 4. It should be understood that apparatus 10 may also be used to join the components forming the holder assemblies described in co-pending U.S. patent application, Ser. No. 09/838,985, filed Apr. 20, 2001, which is incorporated by reference by reference herein in its entirety.

Figure 2:
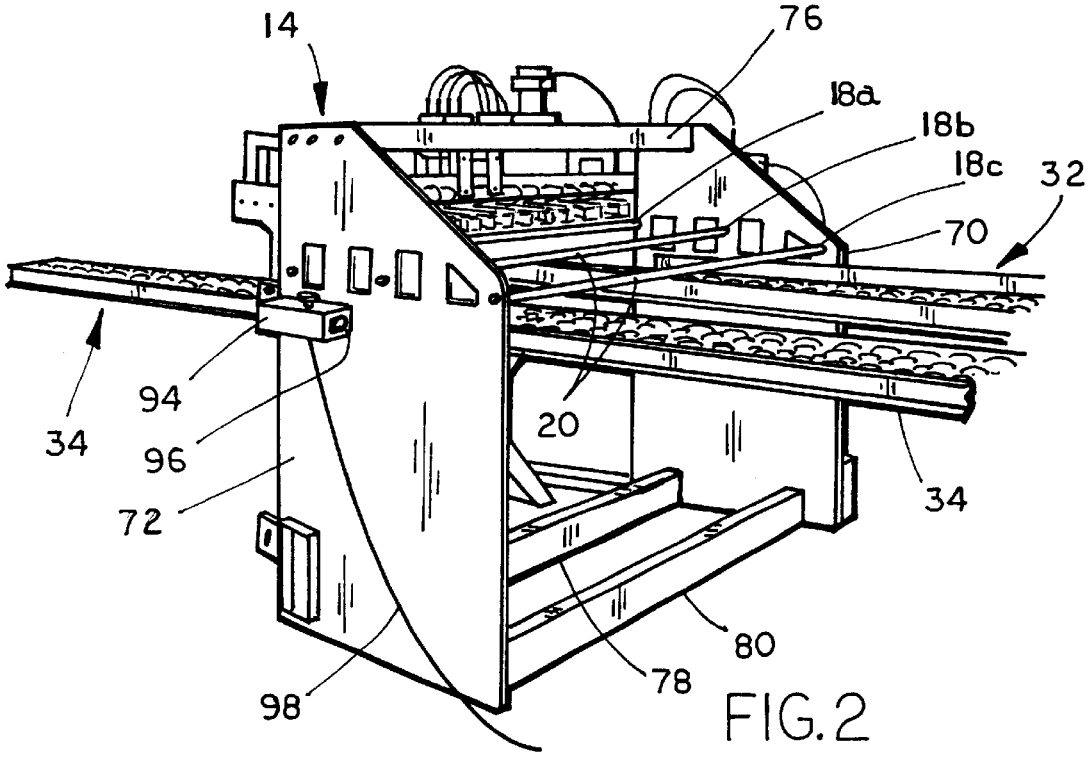
FIG. 2 is a side perspective of the apparatus of FIG. 1.
Figure 3:
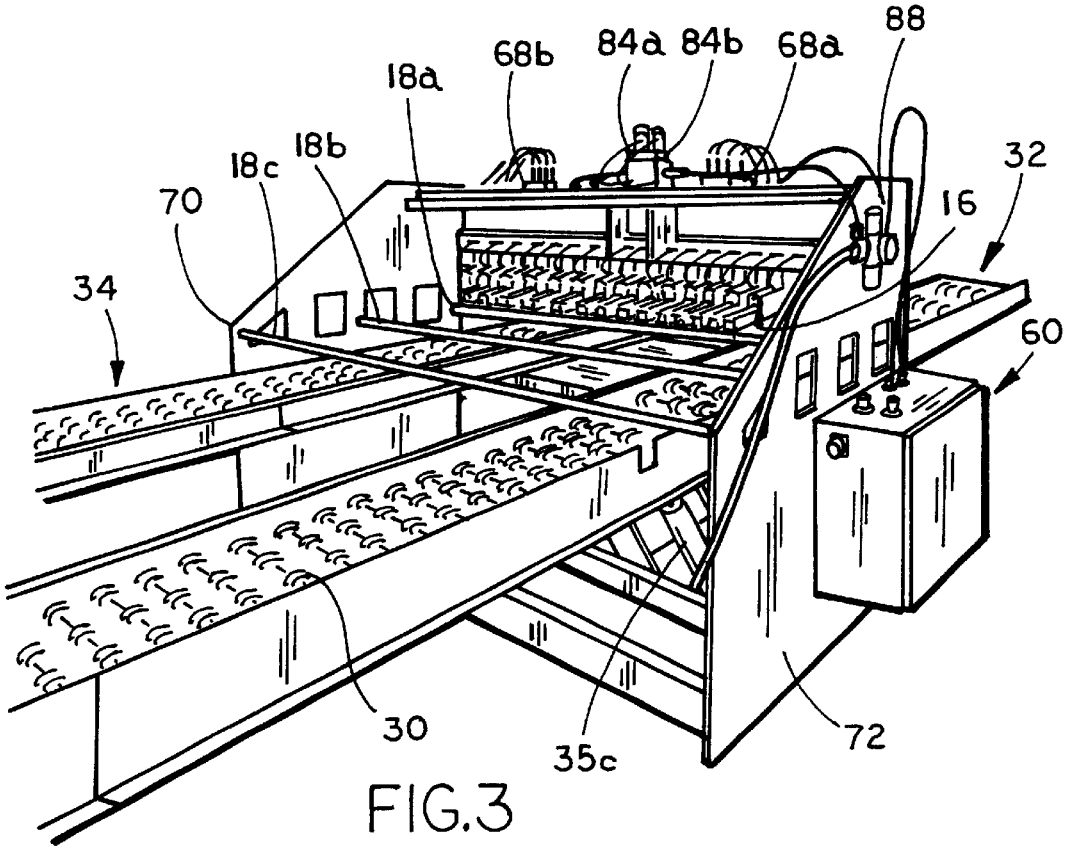
FIG. 3 is a second side perspective view of the apparatus of FIG. 1.
Figure 4:
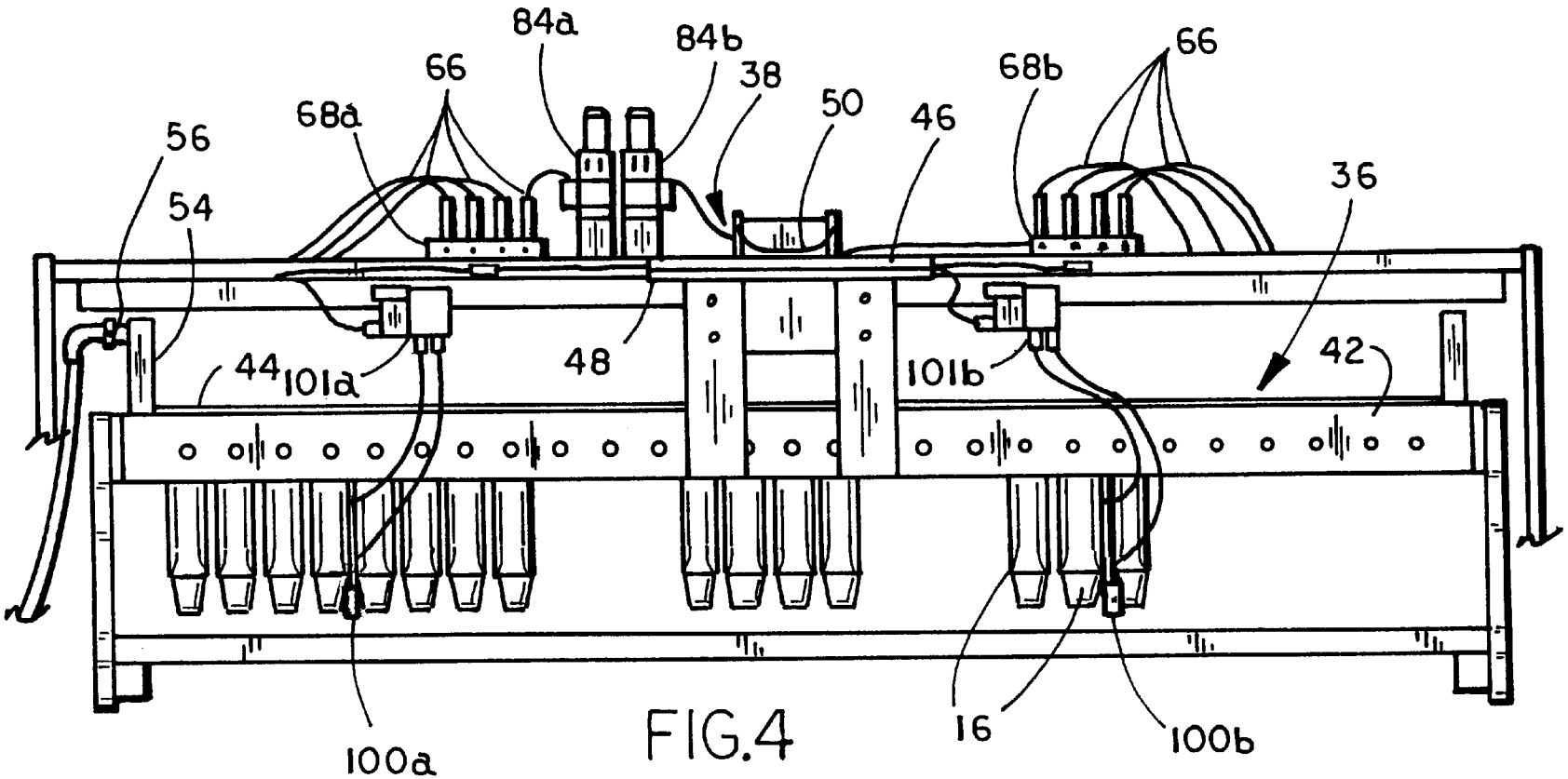
FIG. 4 is an enlarged front elevation view of the stapler assembly of the apparatus of FIG. 1.
Figure 6:
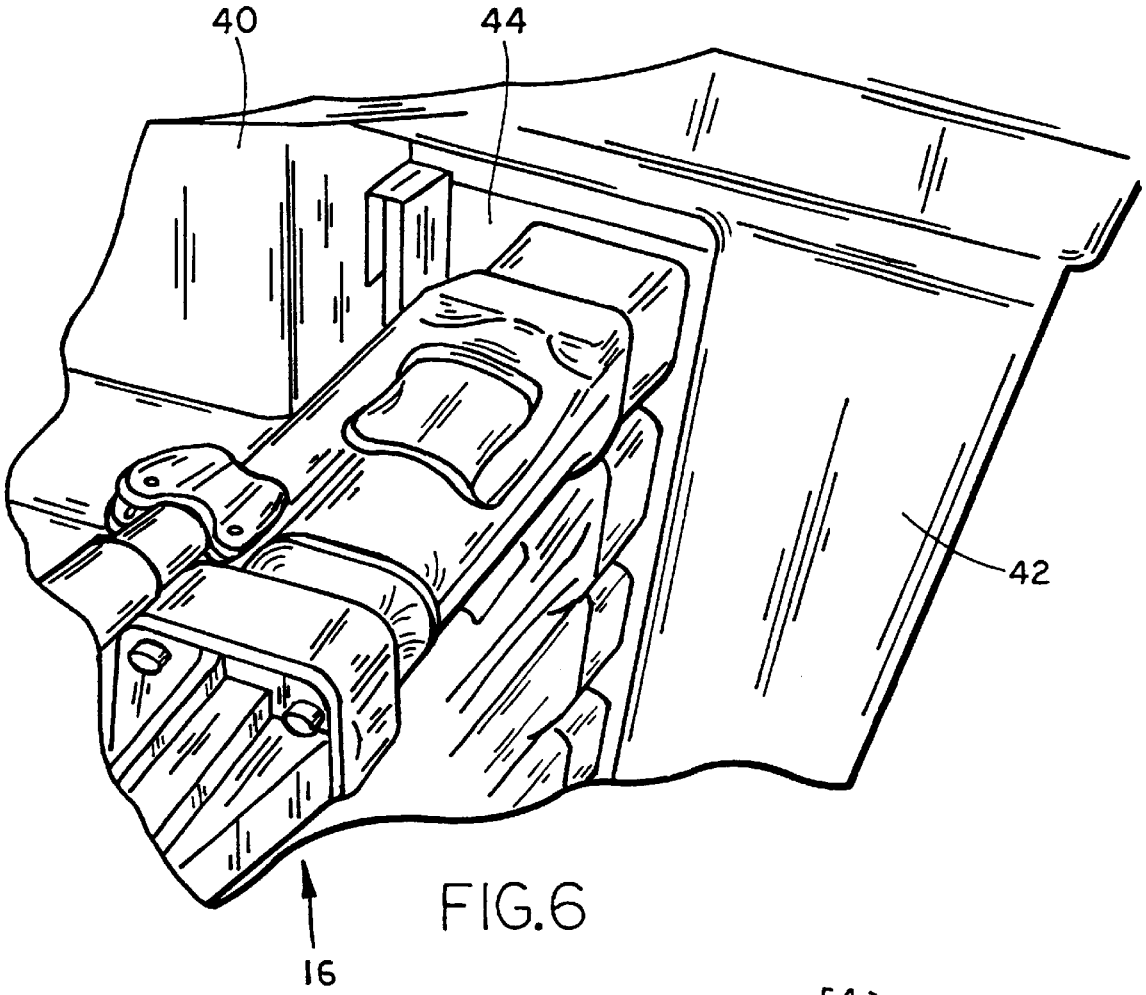
FIG. 6 is a bottom perspective view of the stapler support arm assembly illustrated in FIG. 5 illustrating the mounting of the individual stapler assembly to the support arm assembly.
Figure 7:
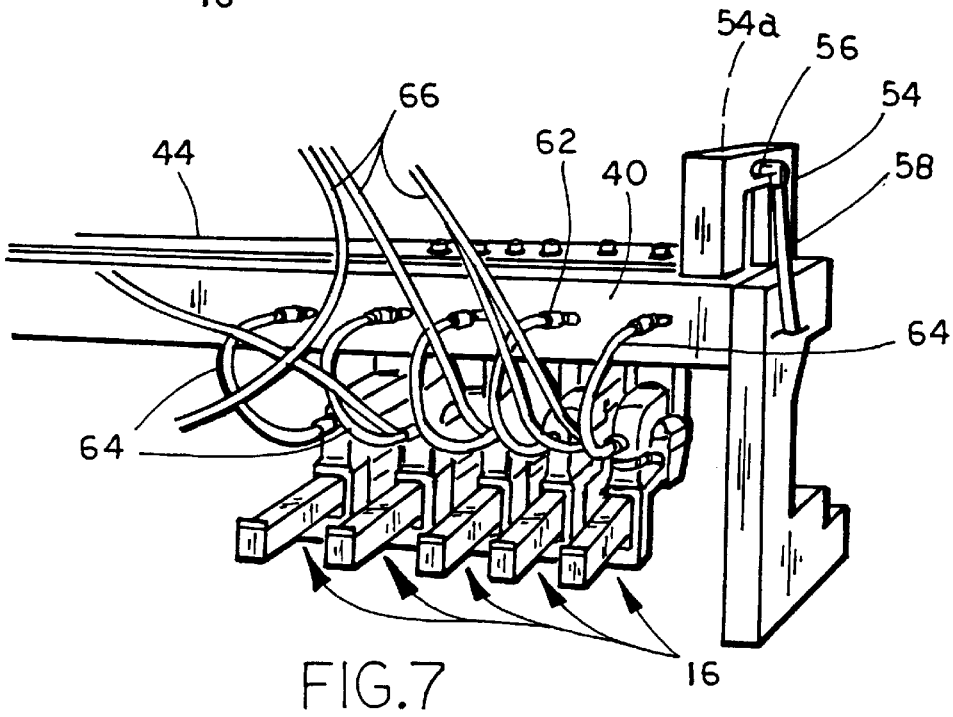
FIG. 7 is a rear enlarged partial fragmentary view of the stapler assembly.

As best seen in FIGS. 1 and 2, apparatus 10 includes a frame 14, which supports a plurality of connector dispensers, such as stapler assemblies 16. Stapler assemblies 16 preferably comprise pneumatic stapler assemblies, such as are available from Bostitch. In addition, apparatus 10 includes transverse supports 18*a,* 18*b,* and 18*c,* which are positioned below stapler assemblies 16 and which provide a support surface 20 for supporting a component to be stapled. In addition, one of the transverse support members, such as transverse support member 18*a,* is aligned below stapler assemblies 16 so that its support surface (20) also provides a strike surface so that the staples will fold as needed to secure the components together. As previously noted, apparatus 10 is particularly suitable for manufacturing a component holder assembly 12 (FIGS. 3 and 4).

Figure 2A:
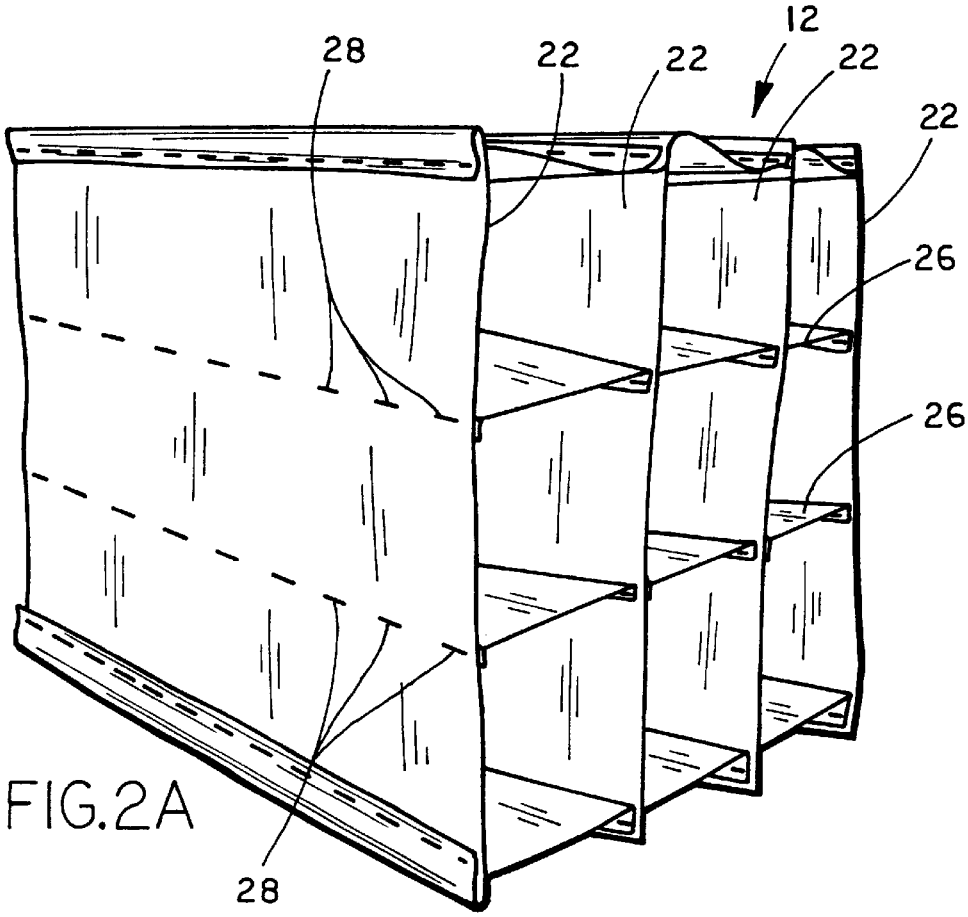
FIG. 2A is a perspective view of a component holder assembly assembled using the apparatus of the present invention.
Figure 2B:
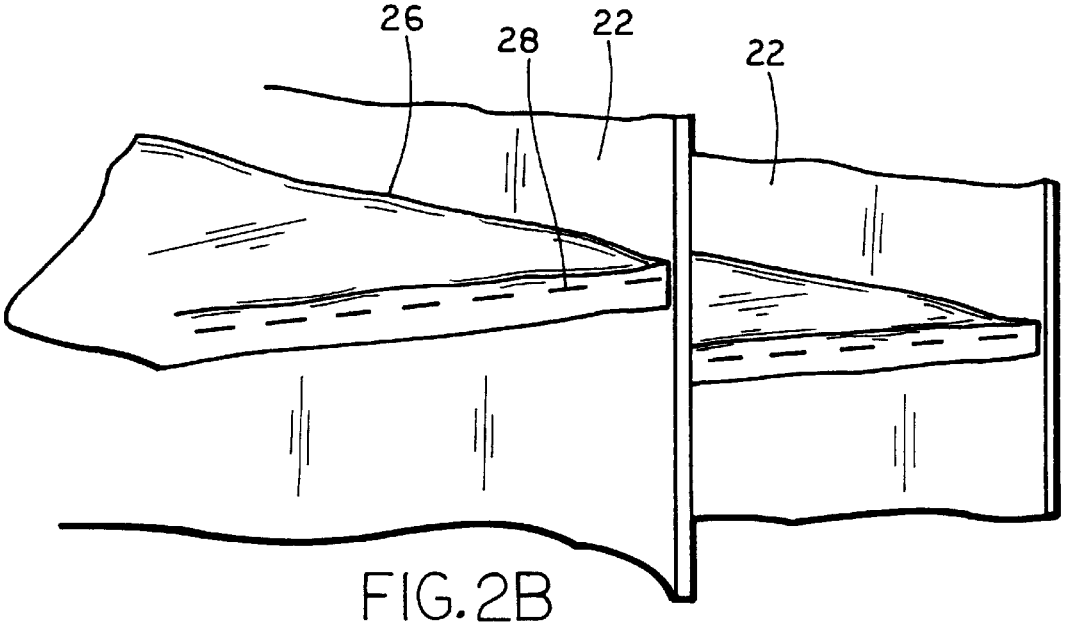
FIG. 2B is an enlarged view of two seams formed by the apparatus of the present invention.

Referring to FIGS. 2A and 2B, component holder assembly 12 includes a plurality of side frame members 22 and a plurality of shelf elements 26, which are connected at their respective side edge portions to respective side frame members 22 by a plurality of connectors or fasteners 28. In the illustrated embodiment, fasteners 28 comprise staples. Depending on the product that is desired to be supported or cradled by component holder assembly 12, it can be appreciated that the length of the shelf and, therefore, the seam formed by the staples may vary considerably. As a result, the assembly process tends to be very time consuming when using conventional heretofore known techniques.

In the illustrated embodiment, shelf elements comprise flexible shelf elements and are formed, for example, from a flexible material, such as a fabric, including canvas, vinyl, or the like. Side frame members 22, on the other hand, are preferably substantially rigid and are formed, for example, from substantially rigid panels, such as plastic panels, cardboard panels, including corrugated plastic or cardboard panels. Alternately, side panels 22 may be flexible, with shelf elements comprising substantially rigid panels, such as described in co-pending U.S. patent application, Ser. No. 09/838,985, filed Apr. 20, 2001, which is incorporated by reference by reference herein in its entirety.

Apparatus 10, as will be more fully described below, permits an entire row of staples (or other connectors) to be applied to the components forming the component holder assembly 12 in a single process step, thus significantly decreasing the assembly time. Thus, when one of the side frame members (22) is positioned on transverse members 18*a*, 18*b*, and 18*c* and a shelf element (26) is positioned over the side frame member under the stapler assemblies (16), the stapler assemblies 16 may be actuated to eject staples to connect the respective shelf element (26) to the side frame member (22). In this manner, the staples form a seam. After securing the first shelf element to the side frame member, the side frame member is moved over the support surface 20 so that another portion of the side frame member is aligned with the stapler assemblies to attach another shelf element (26) in a similar manner.

Referring again to FIG. 1, apparatus 10 further includes a second support surface 30 provided, in the illustrated embodiment, by a pair of roller conveyor sections 32 and 34. Preferably roller conveyor sections 32 and 34 are supported on a lift assembly 35, which raises and lowers the respective conveyor sections to raise and lower second support surface 30. In the illustrated embodiment, lift assembly 35 includes a frame 35*a* , with a pair of extendible arms 35*b*, and a pneumatic cylinder 35*c*, which is actuated by control system 60 (FIGS. 1 and 2C) to raise and lower arms 35*b* to raise or lower support surface 30, as desired. As best seen in FIG. 1, control system 60 optionally includes a foot pedal 60*a*, which may be used to control the flow of fluid to cylinder 35*c* and to thereby actuate cylinder 35*c*, as would be understood by those skilled in the art.

Second support surface 30 is positioned below support surface 20 and is provided so that after all the desired shelf elements are secured to the side frame member, the side frame member can be moved onto second support surface 30 below support surface 20. In this manner, a second side frame member can be positioned on transverse members 18*a*, 18*b*, and 18*c* for connecting to the respective shelf elements already secured to the first side frame member. In order to secure the second side frame member to the shelf elements of the first side frame member, the respective shelf elements are positioned beneath the second side frame member on top of transverse member 18*a*. In this manner, the staples ejected by stapler assembly 16 pass through the second side frame member and through the edge portion of respective shelf element, which are thereafter bent into their proper shape when they impact with the transverse support member 18*a*. The second side frame member is moved across support member 18*a*, 18*b*, and 18*c* in a similar manner to align other portions of the second side frame member with the stapler assemblies (16) and for securing the remaining shelf elements of the first side frame member to the second side frame member. This process is repeated until the entire component holder assembly is assembled.

In the illustrated embodiment, stapler assemblies 16 are supported on a movable support 36. Movable support 36 includes a pair of tubular members 40 and 42 and a mounting plate 44 that interconnects tubular members 40 and 42 and together with tubular members 40 and 42 span support surface 20. Movable support 36 is mounted to frame 14 by a pivot joint 38, which permits support 36 to pivot about a vertical axis 36*a* to adjust the orientation of the seam formed by the staples ejected by stapler assemblies 16. For example, in some applications, it may be desirable to attach a shelf element to the side frame members at an angle. Stapler assemblies 16 are mounted to support plate 44 and are actuated by air delivered through tubular member 40, as will be more fully described below.

Figure 8:
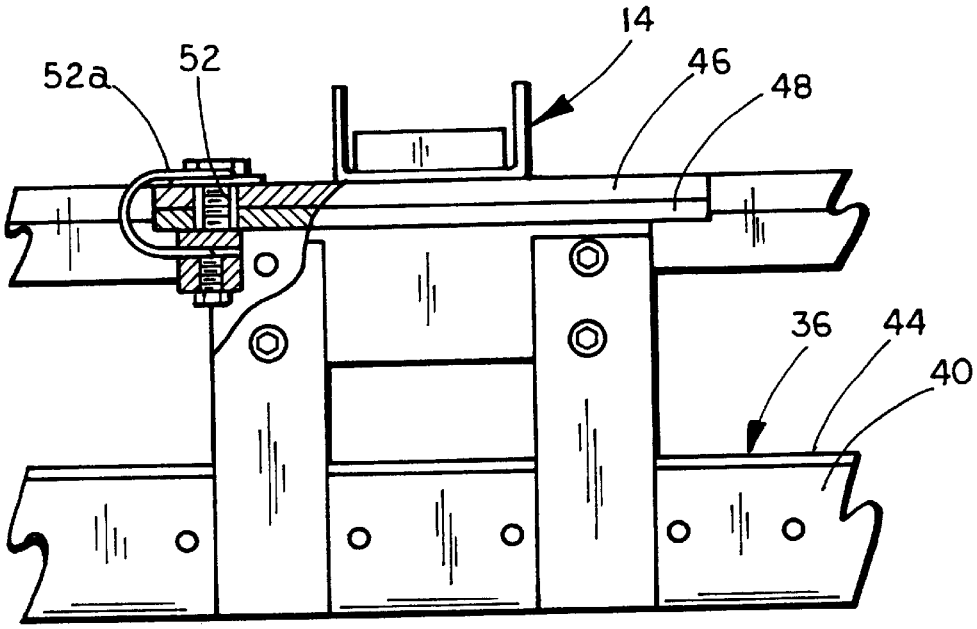
FIG. 8 is an enlarged perspective view of the mounting of the stapler assembly to the frame of the apparatus.

Depicted in FIG. 8, pivot joint 38 includes a first plate member 46, which is fixedly mounted to frame 14, such as by welding, and second plate member 48, which is rotatably mounted to plate member 46 on a shaft 50. Shaft 50 is aligned with axis 36*a*. In this manner, second plate member 48 can pivot about axis 36*a*. In order to fix position of second plate member 48 with respect to plate member 46, each plate includes engagement surfaces, such as transverse openings 52, and a latching device, such as a pin 52*a*, including a spring biased pin, which is selectively actuated to engage respective engagement surfaces of the two plates to thereby fix the angular orientation of support arm 36. In the illustrated embodiment, pin 52*a* is extended through aligned openings of the respective plates when support 36 is in its desired orientation to thereby rotatably couple plate member 48 to plate member 46 and fix the position of movable support 36.

Figure 2C:
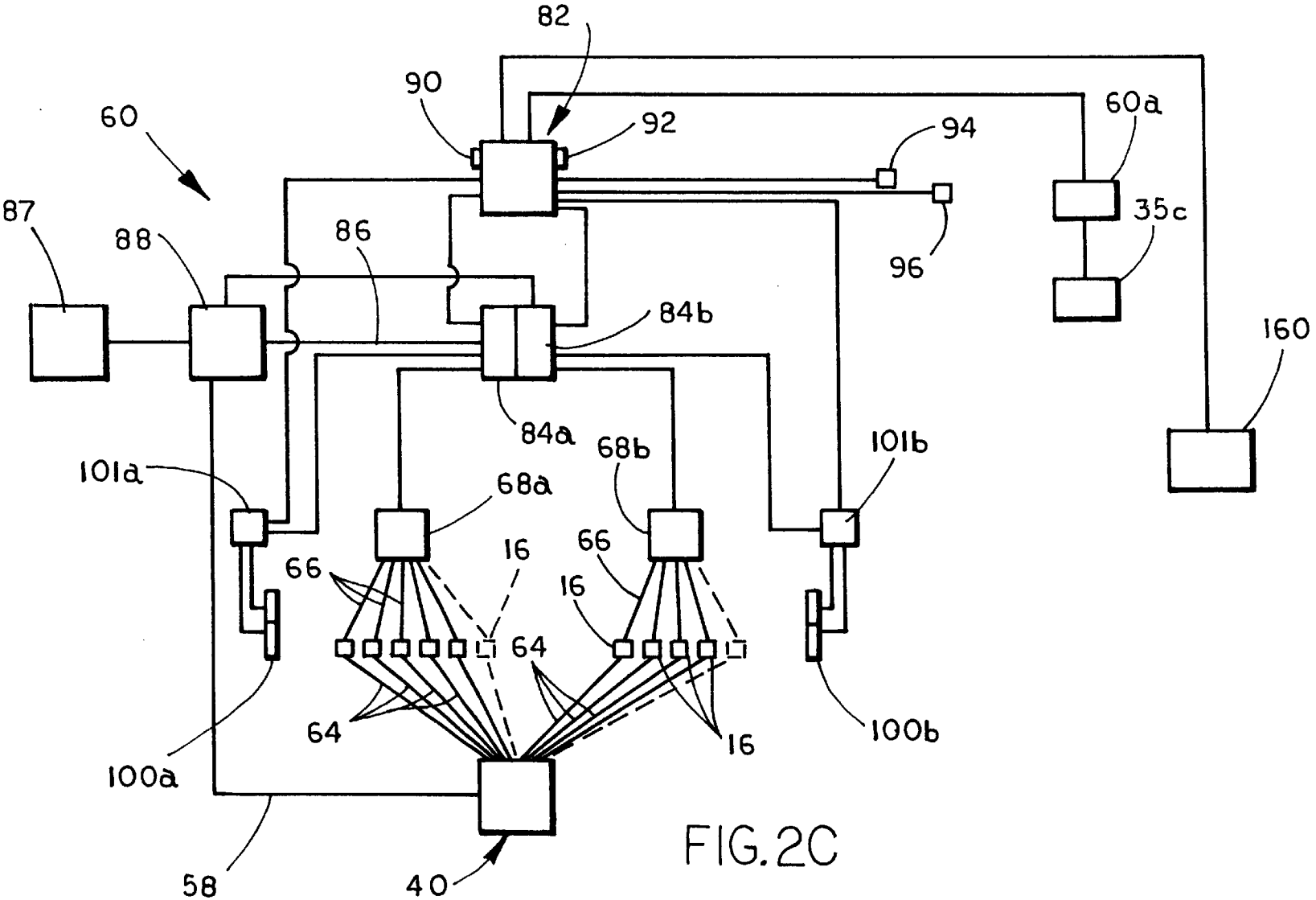
FIG. 2C is a schematic drawing of a control system of the present invention.
Figure 5:
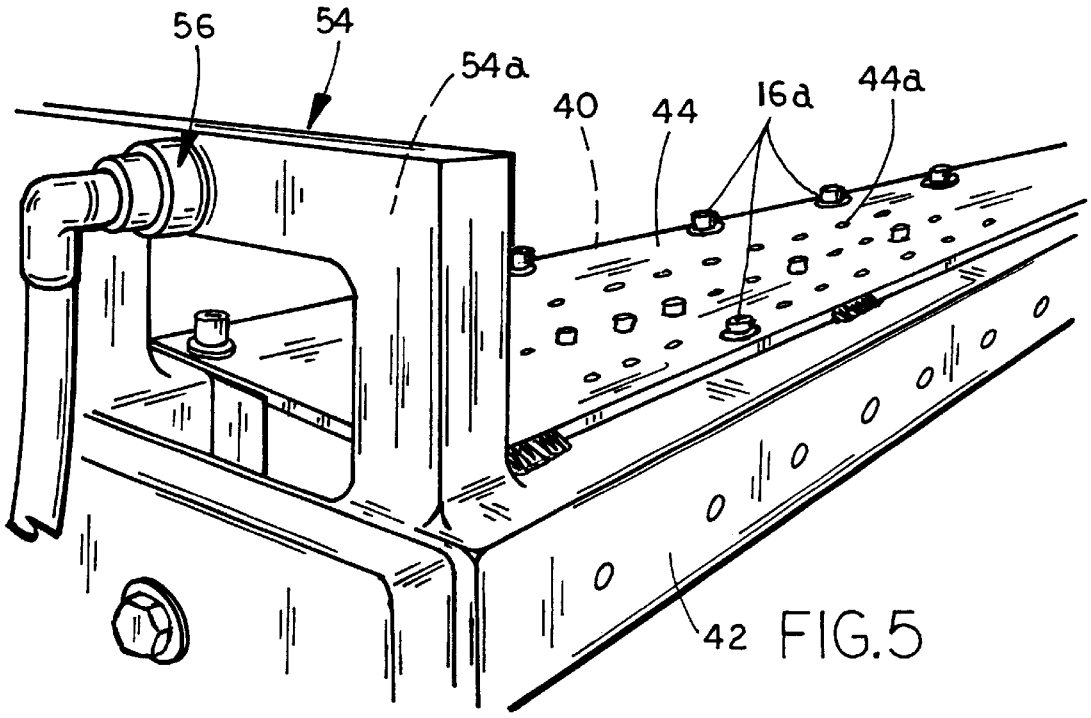
FIG. 5 is an enlarged fragmentary perspective view of the stapler support arm assembly.

As best understood from FIGS. 4–7, tubular member 40 forms a manifold for delivering a fluid, such as air, to stapler assembly 16 to thereby power stapler assemblies 16. Referring to FIG. 5, mounted to tubular member 40 is a U-shaped tubular member 54, which includes a chamber 54*a* and a port 56. Chamber 54*a* is in fluid communication with the respective chambers of both tubular members 40 and 42. Port 56 is coupled to a supply conduit 58, such as a flexible hose, which delivers the fluid, such as air, to the chambers of tubular member 54 and tubular members 40 and 42. As will be more fully described below, supply conduit 58 couples to a supply of fluid 87 (FIG. 2C), which is controlled by a control system 60 (FIGS. 1 and 2C). Tubular member 40 includes a plurality of ports 62 with corresponding supply conduits 64, with each supply conduit 64 associated with and in communication with a respective stapler assembly 16. In the illustrated embodiment, supply conduits 64 couple to respective stapler assemblies 16 and supply powering fluid to the stapler assemblies. In order to trigger stapler assemblies 16, each stapler assembly 16 is in communication with a second supply conduit 66, which supplies a triggering fluid supply. Second supply conduits 66 are in communication with manifolds 68*a* and 68*b*. In the illustrated embodiment, each second supply conduit 66 is coupled to a respective stapler assembly (16) on one end and a respective manifold 68*a*, 68*b* on another end. Manifolds 68*a* and 68*b* are in communication with control system 60, which controls the flow of fluid from manifolds 68*a* and 68*b* to thereby control the flow of triggering fluid to the respective stapler assemblies, as will be more fully described below.

In the illustrated embodiment, apparatus 10 includes two manifolds 68*a* and 68*b* which are respectively associated with a first group of stapler assemblies and a second group of stapler assemblies. It should be understood that a single manifold or more than two manifolds can be used. For example, a first group of the stapler assemblies may be aligned over a first portion of the support surface, with a second group of the stapler assemblies aligned over a second portion of the support surface. As will be more fully described in reference to control system 60, each group of stapler assemblies, therefore, may be individually actuated or triggered. In this manner, selective stapler assemblies can be activated to produce a shorter seam. For example, when a smaller component assembly is being manufactured, it may be desirable to only actuate the first group of staplers. It should be understood that the number of stapler assemblies in each group may be varied as needed. In addition, the number of groups may be increased. For example, each individual stapler assembly may be individually activated.

Each stapler assembly 16 is mounted to plate member 44 by fasteners 16*a*, which permit adjustment and repositioning of the respective stapler assemblies along plate 44. For example, as best seen in FIG. 5, plate 44 includes a plurality of openings 44*a* to permit variation in the space in between the respective stapler assemblies. In addition, stapler assemblies 16 may be arranged in two groups as noted above.

Referring to FIGS. 1–3, in the illustrated embodiment, frame 14 includes two vertical frame members 70 and 72 which are interconnected by upper transverse frame members 74 and 76 and lower transverse frame members 78 and 80. Each vertical frame member 70, 72 may comprise a single plate member or may comprise a composite member formed from a plurality of structural members. Similarly, each transverse frame member 74, 76, 78, and 80 may comprise a tubular member or a composite structure member, as would be understood by those skilled in the art. In addition, frame members 74, 76, 78, and 80 may be assembled using fasteners, welds, rivets, or the like, or a combination thereof.

As best seen in FIGS. 1 and 3, vertical frame member 70 provides a mounting surface for control system 60. Referring to FIG. 2C, control system 60 includes a controller or central processing unit 82 and a pair of solenoid valves 84*a* and 85*b*, which are controlled by central processing unit 82 via electrical connectors 82*a* and 82*b*. Solenoid valves 84*a* and 84*b* are coupled via a supply conduit 86 to a supply of air 87 by regulator or control valve 88, which delivers pressurized air to the solenoid valves 84*a* and 84*b*. Solenoid valve 84*a* is in communication with a first group of the stapler assemblies (16) through manifold 68*a*, and delivers pressurized air to the respective stapler assemblies (16) via manifold 68*a* to trigger the stapler assemblies when activated by central processing unit 82. Similarly, solenoid valve 84*b* is in communication with a second group of stapler assemblies (16) via manifold 68*b* and delivers pressurized air to the stapler assemblies (16) to trigger the stapler assemblies when actuated by central processing unit 82. As noted previously, the power or driving pressure for stapler assemblies 16 is delivered through the manifold formed by tubular member 40, which is in communication with fluid supply 87 via supply conduit 58. In this manner, pressurized air is constantly supplied to stapler assemblies 16, which are actuated only when triggering pressurized air is delivered to the respective stapler assemblies via manifolds 68*a* and 68*b*.

Optionally, control system 60 includes manually actuatable buttons 90 and 92 which when suppressed actuate solenoid valve 84*a* and 84*b*. In the illustrated embodiment, control system 60 includes a second set of manually actuatable buttons 94 and 96, which are mounted to vertical frame member 72 and coupled to central processing unit 82 via wiring 98. In this manner, apparatus 10 can be configured so that stapler assemblies 16 are only triggered when all four buttons are suppressed. It should be understood that the actuatable buttons may be remotely mounted or mounted on a portable hand held box so that the operator can move around apparatus 10 to observe the process at a closer range, as desired.

In addition, referring again to FIG. 2C, control system 60 includes a pair of cylinders 100*a* and 100*b*, such as pneumatic cylinders, which are in communication with solenoid valves 84*a* and 84*b* via solenoid valves 101*a* and 101*b*, which in turn are in communication with central processing unit 82. When actuated by signals from central processing unit 82, solenoid valves 101*a* and 101*b* deliver pressurized fluid to cylinders 100*a* and 100*b* so that cylinders 100*a*, 100*b* extend. When extended, cylinders 100*a* and 100*b* provide a disengagement or pushing force so that after stapling, the component remains on support surface 20 rather than lifting off support surface. While cylinders 100*a* and 100*b* are optional, cylinders 100*a* and 100*b* enable the time between each stapling operation to be reduced; thus, increasing the assembly rate of apparatus 10.

It should be understood that apparatus 10 requires manual repositioning of the various side frame members across the support surface. However, as will be more fully described below in reference to apparatus 110, side frame members 22 of the component assembly may be moved mechanically as well.

Figure 9:
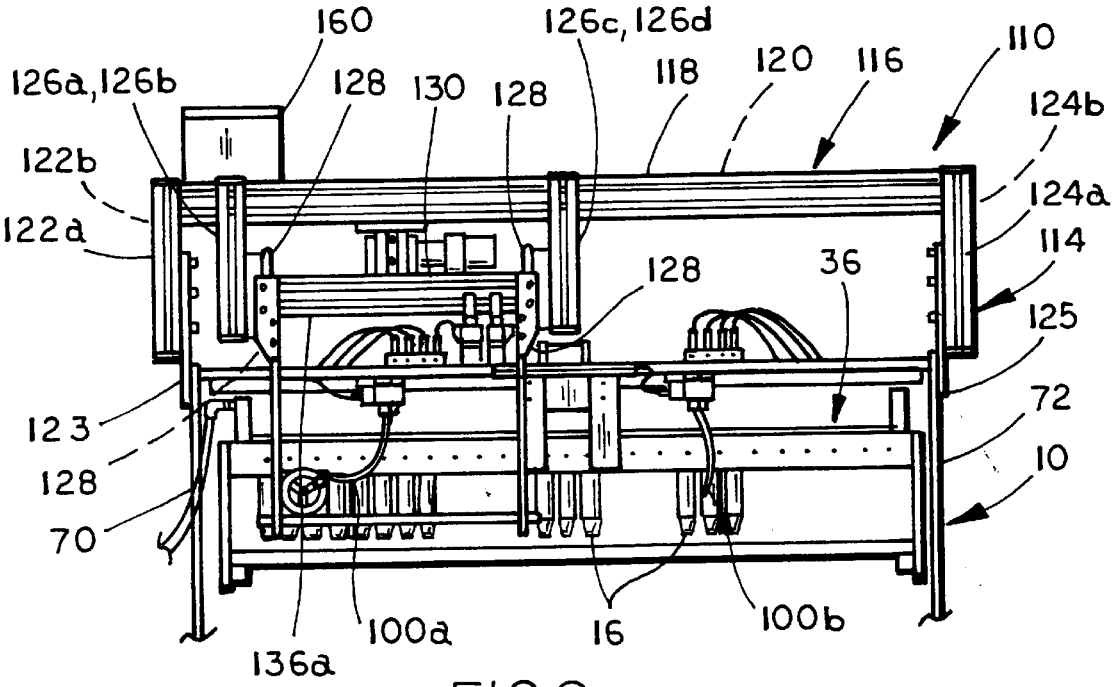
FIG. 9 is a front partial elevation view of the apparatus of FIG. 1 with the apparatus incorporating an indexing assembly.

Referring to FIG. 9, apparatus 110 includes connector dispensing apparatus 10 and an indexing assembly 114. Indexing assembly 114 is provided to move the respective components being stapled across the support surface of connector dispensing apparatus 10 so that the process of moving the components, such as side frame members 22, is automated at least partially.

Referring again to FIG. 9, indexing assembly 114 includes a support frame 116, which is mounted to vertical frame members 70 and 72 of connector dispensing apparatus 10. For example, frame 116 may be bolted, welded, or otherwise secured to vertical frame members 70 and 72. In the illustrated embodiment, support frame member 116 is constructed from a pair of horizontal frame members 118 and 120 and a plurality of vertical frame members 122*a*, 122*b*, and 124*a*, 124*b*. Horizontal and vertical frame members preferably comprise extruded frame members, such as extruded aluminum members, and are interconnected by fasteners. Vertical frame members 122*a* and 122*b* are commonly mounted to a plate 123 which in turn is mounted to vertical side frame members 70 of connector dispensing apparatus 10. Similarly, vertical frame members 124*a* and 124*b* are commonly mounted to a plate 125, which in turn is mounted to vertical side frame members 72 of apparatus 10. Frame 116 also includes a plurality of downwardly extending arms 126*a*, 126*b*, 126*c*, and 126*d*, which are mounted to horizontal members 118 and 120. Each downwardly extending arm 126*a*, 126*b*, 126*c*, and 126*d* includes mounted at its lower end a pair of spaced apart bearings 128 which form tracks, as will be more fully described below. For example, in the illustrated embodiment, bearings 128 comprise wheels, such as low friction wheels. It should be understood that other bearings may also be used, for example linear bearings or the like.

Figure 10:
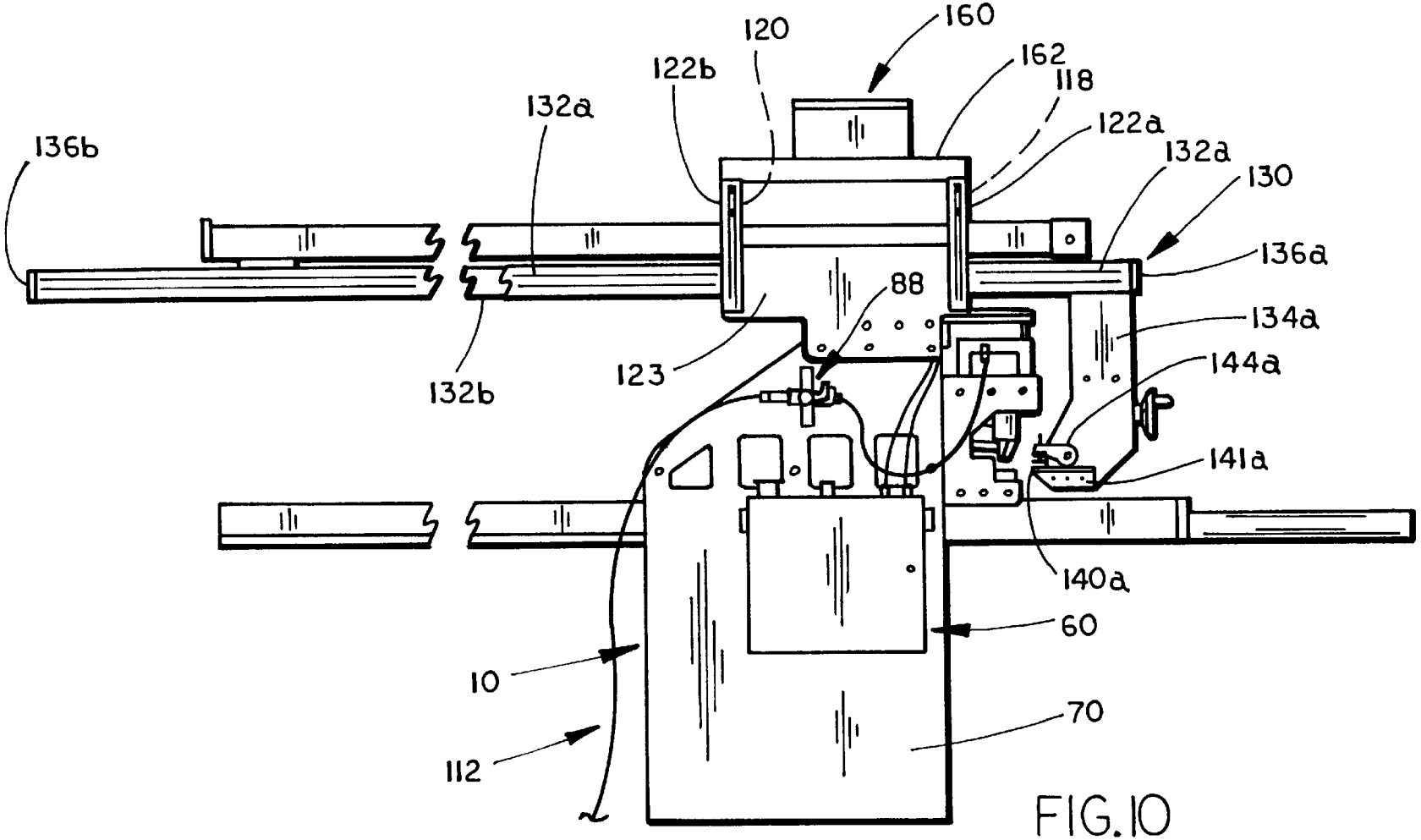
FIG. 10 is a side elevation view of the apparatus of FIG. 9.

Referring to FIG. 10, indexing assembly 114 further includes a gripper assembly 130. Gripper assembly 130 includes a pair of horizontal rails 132*a* and 132*b* and a pair of vertical support plates 134*a* and 134*b*, which are mounted to rails 132*a* and 132*b*, such as by fastening, riveting, welding or the like. Extending between rails 132*a* and 132*b* are transverse support members 136*a* and 136*b*, which interconnect rails 132*a* and 132*b* at mounting plates 134*a* and 134*b* and at the end portions of rails 132*a* and 132*b* to thereby provide lateral support for mounting plates 134*a* and 134*b* and, further, to provide lateral support for rails 132*a* and 132*b*. Rails 132*a* and 132*b* ride on the tracks formed by bearings 128 so that gripper assembly 130 can be moved laterally (as viewed in FIG. 10) with respect to connector dispensing apparatus 10.

Figure 11:
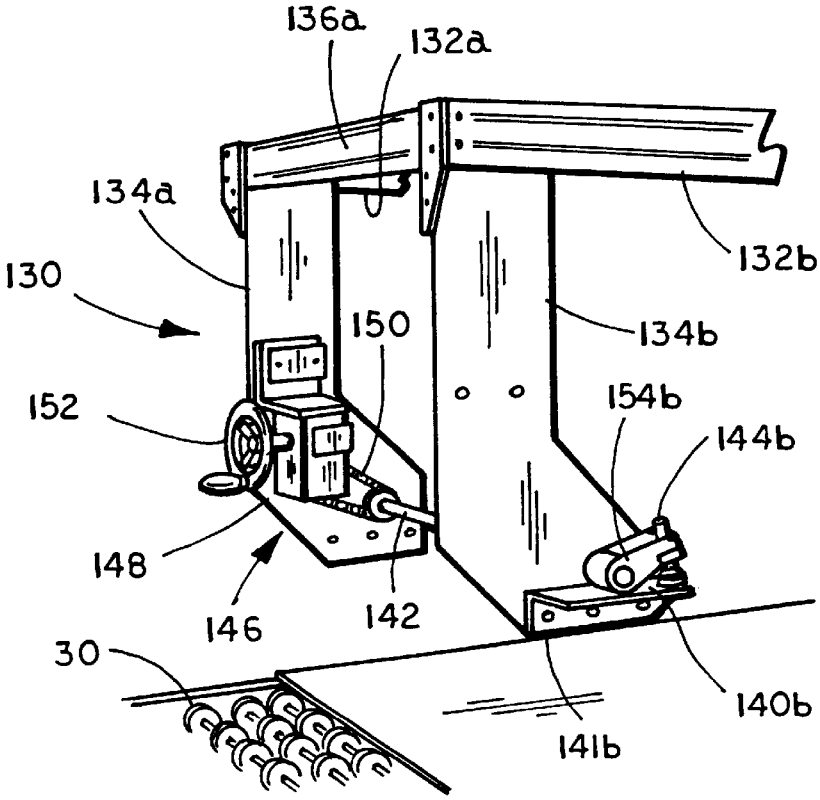
FIG. 11 is a partial fragmentary perspective view of the gripper assembly of the index assembly of FIG. 10.

As best understood from FIG. 10 and FIG. 11, each mounting plate 134*a* and 134*b* includes mounted at its lower edge a bearing surface 140*a*, 140*b* which are provided by angles 141*a* and 14 1*b*, respectively. Extending between mounting plates 134*a* and 134*b* is a shaft 142 which includes end portions that project through mounting plates 134*a* and 134*b* and on which grippers 144*a* (FIG. 10) and 144*b* (FIG. 11) are mounted. In the illustrated embodiment, grippers 144*a* and 144*b* are pivotal grippers and are coupled to shaft 142 so that they pivot with shaft 142, when shaft 142 is rotated about its longitudinal axis. Shaft 142 is rotated by a driver 146. In the illustrated embodiment, driver 146 comprises a manual gear drive 148 which is coupled by a drive chain 150 to shaft 142. Gear drive 148 is mounted to mounting plate 134*a* and is operated by a handled wheel 152.

Figure 12:
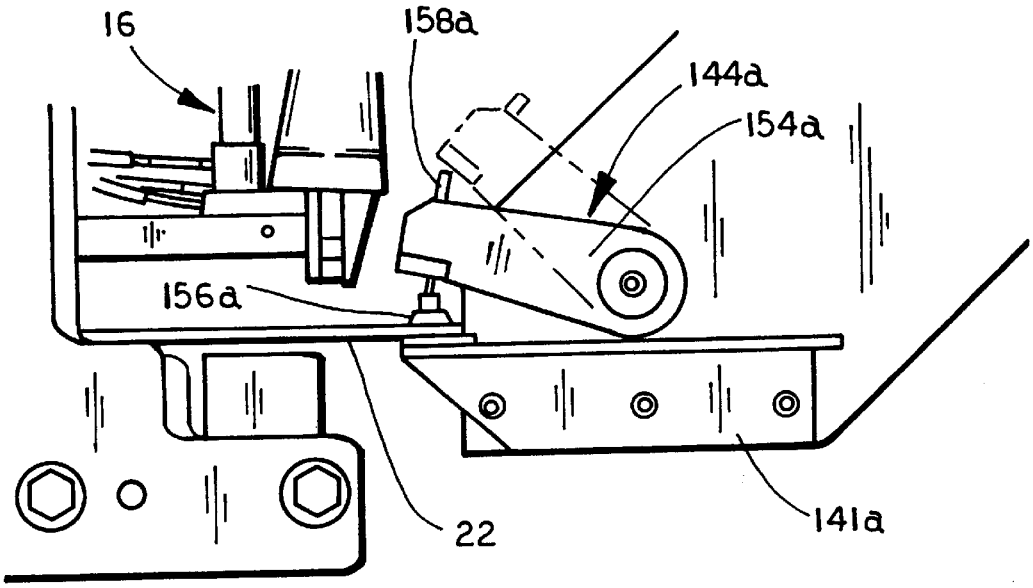
FIG. 12 is an enlarged side elevation view illustrating the gripper assembly gripping a side panel of the component holder assembly.

As best seen in FIGS. 11 and 12, each gripper 144*a*, and 144*b* includes an arm 154*a*, 154*b* and a suction cup 156*a*, 156*b* which is mounted to its respective arm 154*a*, 154*b* by an adjustable rod 158*a*, 158*b*. In this manner, the compressive force of the suction cups on, for example side frame members 22 can be adjusted to accommodate different components thicknesses.

Referring again to FIG. 12, when gripper assembly 130 is actuated and grippers 144*a* and 144*b* are moved to their engaging position (as shown in solid lines in FIG. 12), indexing assembly 114 holds the components, such as side frame members 22, in position so that when the staples are released from stapler assemblies 16 the staples can be properly aligned on side frame members 22.

Optionally, support member 18*a* may include a chuck, such as a pneumatic chuck, to provide a means to hold the component on the support surface. This is particularly helpful when a flexible component needs to be held. Preferably, control system 60 is in communication with the chuck, such as by a vacuum line and another solenoid valve which opens and closes in response to signals from the controller to actuate the vacuum.

In order to move gripper assembly 130 along bearings 128, indexing assembly 114 includes a driver, such as a motor 160. Motor 160 is mounted to frame 116 by a mounting member 162, such as a plate, which extends between horizontal members 118 and 120, and is drivingly coupled to gripper assembly 130 so that when motor 160 is energized, gripper assembly 130 moves along the tracks formed by bearings 128. Preferably, motor 160 is in communication with control system 160 (FIG. 2C) and is actuated by control system 160 to move gripper assembly 130 along the tracks formed by bearings 128, in order to move the component being stapled across support surface 20, as described above.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. An apparatus for manufacturing a component holder assembly, said apparatus comprising:

a frame;

a plurality of stapler assemblies supported by said frame and generally aligned along a common axis for ejecting staples along said common axis;

a support surface for supporting at least a first side frame member of a component holder assembly whereby a portion of the first side frame member can be aligned with said stapler assemblies; and means for actuating at least a group of said stapler assemblies to eject staples generally along said common axis to form a seam for connecting a shelf member of the component holder assembly to the first side frame member of the component holder assembly.

2. The apparatus according to claim 1, wherein said plurality of stapler assemblies are pivotally mounted to said frame whereby rotation of said stapler assemblies adjusts the orientation of said common axis for adjusting the orientation of the seam.

3. The apparatus according to claim 1, further comprising an indexing assembly, said indexing assembly including at least one gripper for holding the first side frame member of the component assembly and for moving the first side frame member across said support surface for indexing the first side frame member and aligning another portion of the first side frame member with said stapler assemblies.

4. The apparatus according to claim 3, wherein said indexing assembly is mounted to said frame.

5. The apparatus according to claim 4, wherein said indexing assembly includes a gripper assembly, said at least one gripper comprising a first gripper, and said gripper assembly including said first gripper and a second gripper, said first and second grippers for gripping the first side frame member and moving the first side frame member across said support surface for repositioning the first side frame member with respect to said stapler assemblies.

6. The apparatus according to claim 5, wherein said gripper assembly includes a gripper assembly frame and a carriage, said first and second grippers supported by said carriage, and said carriage movably mounted to said gripper assembly frame.

7. The apparatus according to claim 6, wherein said carriage includes a plurality of rails, said gripper assembly frame including a plurality of bearing assemblies, said rails movably supported by said bearing assemblies whereby said carriage moves relative to said gripper assembly frame for indexing the first side frame member.

8. The apparatus according to claim 4, wherein said stapler assemblies comprise pneumatic stapler assemblies.

9. The apparatus according to claim 1, further comprising a striker member, said striker member generally aligned with said stapler assemblies and said support surface whereby a portion of the first side frame member is positionable over said striker member when said stapler assemblies are actuated.

10. The apparatus according to claim 1, wherein said support surface comprises a first support surface, said apparatus further comprising a second support surface, said second support surface positioned below said first support surface whereby the first side frame member is positionable on said second surface after said first side frame member is stapled to the self member and optional additional shelf members.

11. The apparatus according to claim 10, wherein said second support surface is repositionable with respect to said first support surface to accommodate a plurality of side frame members of a component holder assembly.

12. The apparatus according to claim 10, wherein said second support surface comprises a conveyor surface.

13. The apparatus according to claim 12, wherein said conveyor surface comprises a roller conveyor surface.

14. An apparatus for manufacturing a component holder assembly, said apparatus comprising:

a frame;

a support arm supported by said frame;

a plurality of stapler assemblies supported by said support arm and generally aligned along a common axis for ejecting staples along said common axis;

a support surface for supporting at least a first side frame member of a component holder assembly whereby a portion of the first side frame member is alignable with said stapler assemblies; and a control system for actuating said stapler assemblies to eject staples aligned generally along said common axis to form a seam for connecting a shelf member to the first side frame member of the component holder assembly.

15. The apparatus according to claim 14, further comprising a means for indexing the first side frame member whereby different portions of the side frame member are alignable with said stapler assemblies for connecting additional shelf members to the first side frame member.

16. The apparatus according to claim 15, wherein said means for indexing comprises an indexing assembly, said indexing assembly including at least one gripper for holding the first side frame member of the component assembly and for moving the first side frame member across said support surface for indexing the first side frame member and aligning another portion of the first side frame member with said stapler assemblies.

17. The apparatus according to claim 16, wherein said indexing assembly is mounted to said frame.

18. The apparatus according to claim 16, wherein said indexing assembly further includes a gripper assembly frame and a carriage having a plurality of rails, said carriage including said at least one gripper, said gripper assembly frame including a plurality of bearing assemblies, said rails movably supported by said bearing assemblies whereby said carriage moves relative to said gripper assembly frame for indexing the first side frame member.

19. The apparatus according to claim 15, wherein said support surface comprises a first support surface, said apparatus further comprising a second support surface, said second support surface positioned below said first support surface whereby the first side frame member is positionable on said second surface after said first side frame member is stapled to the self member and the optional additional shelf members.

20. The apparatus according to claim 19, further comprising a lift assembly, said lift assembly raising and lowering said second support surface.

21. The apparatus according to claim 20, wherein said control system is in communication with said lift assembly whereby said control system selectively actuates said lift assembly.

22. The apparatus according to claim 15, further comprising a striker member, said striker member generally aligned below said stapler assemblies and aligned with said support surface whereby a portion of the first side frame member is positionable over said striker member when said means for indexing moves the first side frame member to align the portion of the first side frame with the stapler assemblies.

23. The apparatus according to claim 22, wherein said striker member is configured to hold at least one member of the component holder assembly.

24. The apparatus according to claim 23, wherein said striker member includes an actuatable chuck, said control system in communication with said chuck whereby said chuck is actuated for selectively holding at least one member of the component holder assembly.

25. The apparatus according to claim 24, wherein said chuck comprises a pneumatic chuck.

26. The apparatus according to claim 14, wherein said stapler assemblies comprise pneumatic stapler assemblies, said control system comprising a pneumatic control system for selectively actuating said pneumatic stapler assemblies.

27. An apparatus for manufacturing a holder assembly, said apparatus comprising:

a frame;

means for dispensing connectors generally aligned along a common axis for connecting a first component of the holder assembly to a second component of the component holder assembly and for forming a seam with said connectors along said common axis;

a support surface configured for supporting at least one of the first component and the second component whereby a portion of the at least one component is alignable with said means for dispensing; and means for indexing the at least one component whereby a selected portion of the at least one component is aligned with said means for dispensing.

28. The apparatus according to claim 27, said frame further comprising a support arm, said means being supported by said support arm.

29. The apparatus according to claim 28, wherein said support arm is pivotally mounted to said frame whereby rotation of said support arm adjusts the orientation of said common axis for adjusting the orientation of the seam.

30. The apparatus according to claim 29, wherein said means for dispensing includes a plurality of stapler assemblies.

31. The apparatus according to claim 30, wherein said stapler assemblies comprise pneumatic stapler assemblies.

32. The apparatus according to claim 30, wherein said means for dispensing further includes a striker member, said striker member generally aligned with said stapler assemblies and said support surface whereby a portion of the at least one component is positionable over said striker member.

33. The apparatus according to claim 27, further comprising a control system for actuating said means for dispensing.

34. The apparatus according to claim 27, wherein said support surface comprises a first support surface, said apparatus further comprising a second support surface, said second support surface positioned below said first support surface whereby the at least one component is positionable on said second surface after the at least one component is stapled to the other component and optional subsequent components.

35. The apparatus according to claim 34, further comprising a lift assembly, said lift assembly raising and lowering said second support surface.

36. The apparatus according to claim 35, wherein said control system is in communication with said lift assembly whereby said control system selectively actuates said lift assembly.

37. The apparatus according to claim 36, wherein said means for indexing comprises an indexing assembly, said indexing assembly including at least one gripper for holding the at least one component of the holder assembly and for moving the at least one component across said support surface for indexing the at least one component and aligning another portion of the at least one component with said stapler assemblies.

38. The apparatus according to claim 37, wherein said indexing assembly includes a gripper assembly frame and a carriage having a plurality of rails, said carriage supporting said at least one gripper, said gripper assembly frame including a plurality of bearing assemblies, said rails movably supported by said bearing assemblies whereby said carriage moves relative to said gripper assembly frame for indexing the at least one component.

39. The apparatus according to claim 38, wherein said control system is in communication with said indexing assembly, said control system selectively moving said carriage with respect to said bearing assemblies.

* * * * *